US005332047A

United States Patent [19]

Hignite

[11] Patent Number: 5,332,047

[45] Date of Patent: Jul. 26, 1994

[54] PILE DRIVING APPARATUS AND METHOD

[75] Inventor: Walter Hignite, West Bend, Wis.

[73] Assignee: John Marino, River Hills, Wis. ; a part interest

[21] Appl. No.: 955,502

[22] Filed: Oct. 1, 1992

[51] Int. Cl.[5] ..... E02D 7/08

[52] U.S. Cl. ..... 173/1; 173/90; 173/128; 173/184; 405/232

[58] Field of Search ..... 173/90, 91, 128, 1, 173/184, 28; 405/232

[56] References Cited

U.S. PATENT DOCUMENTS

| | | | |
|---|---|---|---|
| 1,569,763 | 1/1926 | Litter | 173/128 |
| 1,800,727 | 4/1931 | Harter | 173/128 |
| 2,145,420 | 1/1939 | Hornbecker | 173/128 |
| 3,815,373 | 6/1974 | Giroux | 405/232 |
| 4,231,435 | 11/1980 | Andréasson | 173/128 |
| 4,667,746 | 5/1987 | Moraly | 405/232 |
| 5,002,432 | 3/1991 | Dysarz | 405/232 |

FOREIGN PATENT DOCUMENTS

| | | | |
|---|---|---|---|
| 921714 | 2/1973 | Canada | 405/232 |
| 725179 | 5/1932 | France | 405/232 |

*Primary Examiner*—Scott Smith

*Attorney, Agent, or Firm*—Andrus, Sceales, Starke & Sawall

[57] ABSTRACT

A pile driving apparatus and method includes a hammer assembly having a guide member extending therefrom. The guide member is engageable with the pile, and the hammer is connected to the end of a crane line or the like. A retainer chain is interconnected between the hammer and the pile. The hammer is lifted and lowered in response to operation of the crane, and the retainer chain functions to maintain the guide member in engagement with the pile during upward movement of the hammer. The pile thus functions to guide upward and downward movement of the hammer as it is raised and lowered in response to operation of the crane.

9 Claims, 2 Drawing Sheets

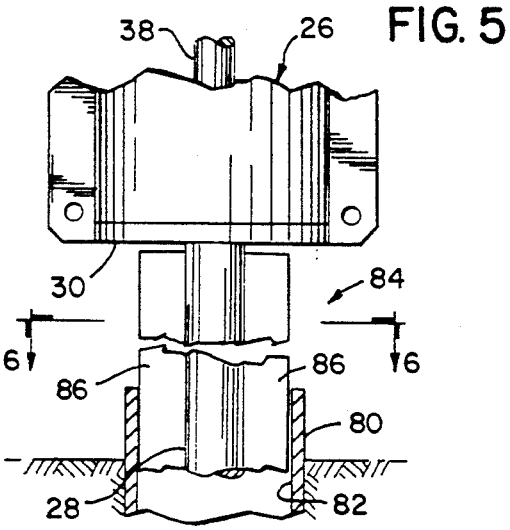
FIG. 5
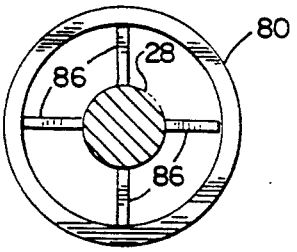
FIG. 6
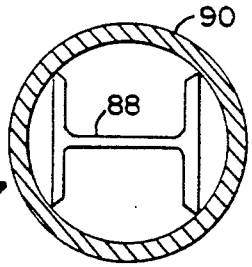
FIG. 7
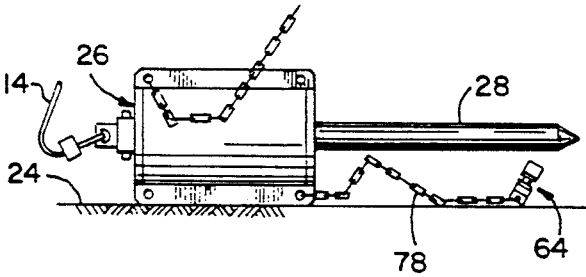
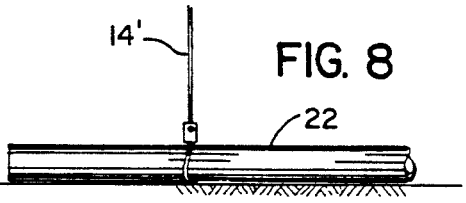
FIG. 8
FIG. 9
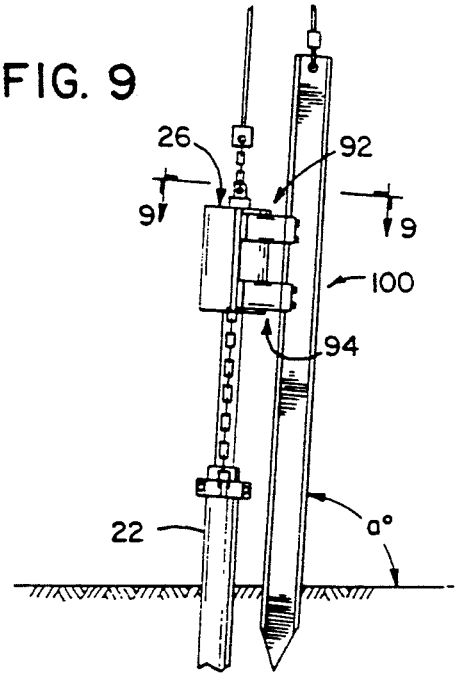
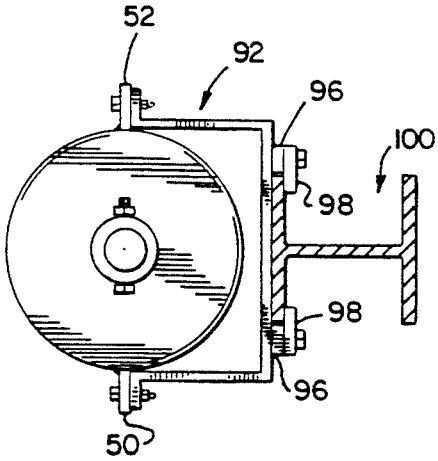
FIG. 10

PILE DRIVING APPARATUS AND METHOD

BACKGROUND AND SUMMARY

This invention relates to a pile driving apparatus and method.

Piles are typically driven using a lead structure suspended from a crane or the like. The lead structure includes a passage within which the upper end of the pile is received, and a hammer is mounted for up and down movement to the lead structure. The hammer is raised upwardly within the lead structure by any satisfactory system, such as one utilizing compressed air and steam, diesel fuel or hydraulic oil, and is then allowed to fall downwardly on the pile, for driving the pile into the ground.

The lead structures in prior art pile driving systems are generally bulky and difficult to maneuver when driving piles in tight spaces. Further, many pile driving systems require use of auxiliary equipment, such as a compressor, which must be hauled to and from the site. Such systems are also relatively expensive, in that the lead structure is a fairly complicated piece of equipment and incorporates a number of fittings for the hammer raising system.

It is an object of the present invention to provide a pile driving apparatus and method which is extremely simple and relatively inexpensive in its construction and operation. It is a further object of the invention to provide a pile driving system adapted for use in tight spaces by eliminating the need for a bulky lead structure.

In accordance with the invention, a pile driving method includes providing a crane having a line adapted for lifting and lowering, and connecting a hammer directly to the line, with the hammer including guide structure. The hammer guide structure is engaged with the pile, and the hammer is reciprocated in an up and down manner by operation of the crane while the guide structure is maintained in engagement with the pile. In this manner, the pile functions to guide the hammer during up and down movement of the hammer in response to operation of the crane. The guide structure is in the form of a guide member which extends from the hammer. In one form of the invention, the pile includes an axially extending passage, and the hammer guide member is engaged within the passage of the pile. The guide member is maintained within the passage in the pile during up and down movement of the hammer. The guide member is provided with a cross-section corresponding in shape to the passage of the pile and in close tolerance to the internal walls of the pile defining the passage, for preventing lateral movement of the hammer relative to the pile as the hammer is being moved upwardly and downwardly in response to operation of the crane. In the event the passage of the pile is larger than the guide structure, an auxiliary guide structure can be mounted to the guide member, with the auxiliary guide structure having a shape corresponding in cross section to that of the pile passage. The step of maintaining the guide structure in engagement with the pile can be carried out with the assistance of a flexible member, such as a chain, interconnected between the hammer and the pile for preventing the hammer from being raised relative to the pile an amount sufficient to disengage the guide structure from the pile. The hammer includes an opening within which one end of the chain is engaged, and the other end of the chain is mounted to a collar assembly mounted to the pile.

The invention further includes a unique and simple arrangement for mounting the hammer to the pile, and also for driving a battered pile, i.e. a non-vertical pile, into the ground.

The invention further contemplates a pile driving apparatus substantially in accordance with the foregoing summary of the pile driving method of the invention.

Various other objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 5 is an enlarged partial elevation view, with portions in section, showing an arrangement for adapting the pile driving apparatus for use with a large-diameter pile;

FIG. 6 is a section view taken along line 6—6 of FIG. 5;

FIG. 7 is a view similar to FIG. 6 showing a modification of the pile driving system of the invention for use in driving I-shaped and H-shaped piles;

FIG. 8 is an elevation view showing the position of the hammer assembly for mounting a pile to the guide member extending from the hammer;

FIG. 9 is a partial elevation view showing an arrangement for driving a battered pile utilizing the pile driving apparatus and method of the invention; and FIG. 10 is a section view taken along line 9—9 of FIG. 8.

DETAILED DESCRIPTION OF THE INVENTION

Figure 1:
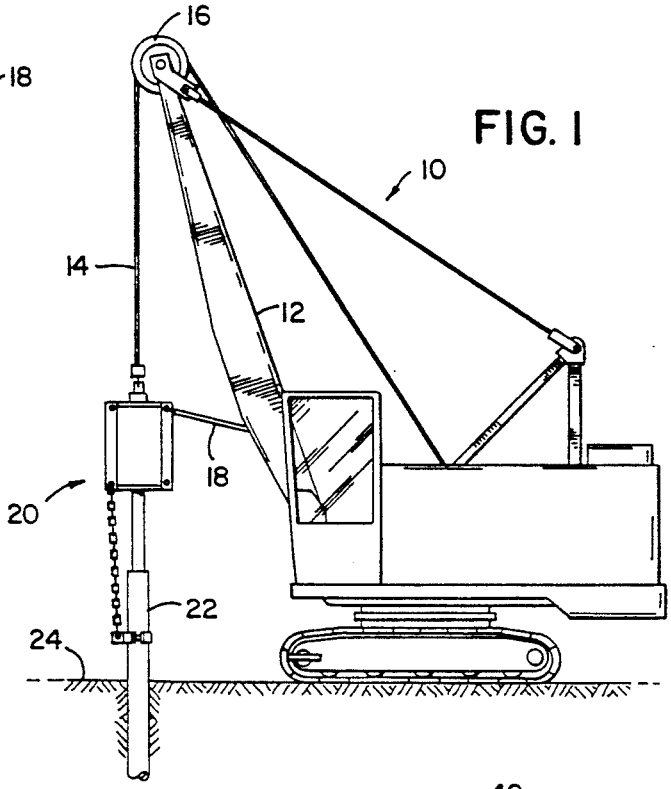
FIG. 1 is a schematic elevation view showing the pile driving apparatus and method of the invention.

FIG. 1 illustrates a crane 10 having a boom 12 and a line 14 engaged with a pulley 16, mounted to the outer end of boom 12. Crane 10 further includes a tag line 18 connected to boom 12. As is known, operation of crane 10 results in raising and lowering of line 14.

A pile driving apparatus 20 is connected to the end of line 14 for driving a pile 22 into the ground, shown at 24, in response to operation of crane 10.

Figure 2:
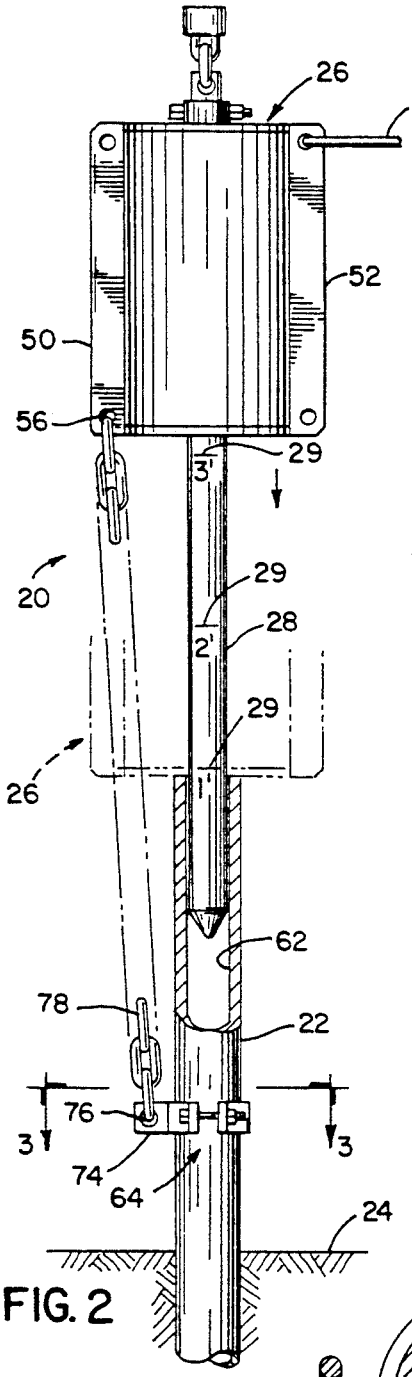
FIG. 2 is an enlarged partial elevation view showing the pile driving apparatus and method of FIG. 1, with a portion of the pile broken away.

As shown in FIG. 2, pile driving apparatus 20 includes a hammer 26 and a guide member 28. Guide member 28 includes markings 29 at spaced intervals, such as at intervals of one foot.

Figure 4:
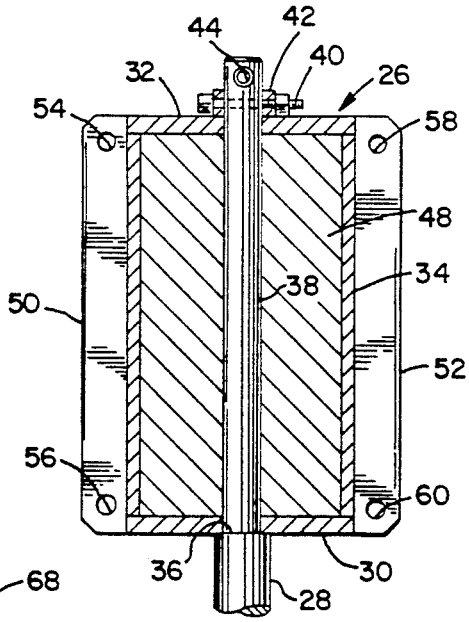
FIG. 4 is a longitudinal sectional view taken through the hammer of the pile driving apparatus of FIGS. 1 and 2.

The construction of hammer 26 and guide member 28 is illustrated in detail in FIG. 4. Referring to FIG. 4, hammer 26 consists of a lower plate 30 and an upper plate 32, each of which is provided with a central opening. A cylinder 34 extends between and is mounted to lower plate 30 and upper plate 32. A shoulder 36 formed in guide member 28, abutting the underside of plate 30. Guide member 28 further includes a reduced diameter portion 38 extending upwardly from shoulder 36 and through the central opening formed in upper plate 32. A transverse passage is formed through the upper end of reduced diameter portion 38, and a bolt 40 extends through the passage and through a collar member 42 surrounding the upper end of reduced diameter portion 38. This arrangement securely mounts guide member 28 to hammer 26.

A second passage, shown at 44, is provided above the passage through which bolt 40 extends. The lower link of a chain 46 (FIG. 2) is received within passage 44. The upper end of chain 46 is connected to the lower end of line 14 to connect hammer 26 to line 14.

The interior of hammer 26 is filled with a heavy material such as lead, shown in FIG. 4 at 48. Plates 50 and 52 are welded to opposite sides of hammer 26. Upper and lower openings 54, 56, respectively are formed in plate 50, and upper and lower openings 58, 60, respectively are formed in plate 52.

In an experimental embodiment of the invention, hammer 26 is approximately twenty-four inches in diameter and forty inches high, having a total weight of approximately 4,700 pounds.

As shown in FIG. 2, tag line 18 of crane 10 is connected to hammer 26 through upper opening 58 in plate 52.

As further illustrated in FIG. 2, pile 22 is in the form of an elongated cylindrical pipe defining an internal passage 62. Guide member 28 defines a cross-section corresponding in shape to passage 62 of pile 22, with the outside diameter of guide member 28 being only slightly less than the internal diameter of pipe 22 defining passage 62.

Figure 3:
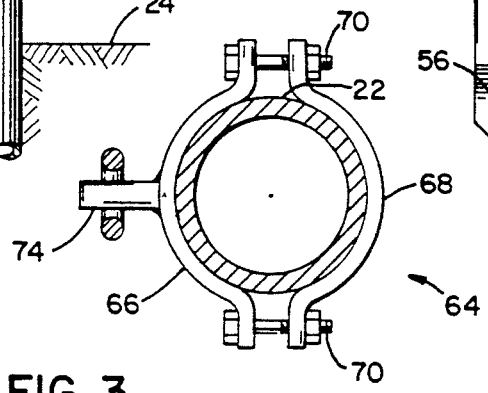
FIG. 3 is a section view taken along line 3—3 of FIG. 2.

A collar assembly, shown generally at 64, is adapted for mounting to pile 22. Referring to FIG. 3, collar assembly 64 includes a pair of mirror-image bracket members 66, 68. The spaced end portions of each of brackets 66, 68 are provided with openings therethrough adapted to receive the shaft of a bolt 70. Bolts 70 and their associated units function to firmly clamp collar assembly 64 onto the exterior of pile 22.

An ear 74 (FIGS. 2, 3) having an opening 76 therethrough is mounted to bracket 66. A retainer chain 78 is mounted to ear 74 through opening 76. The upper end of retainer chain 78 is mounted to plate 50 of hammer 26 through opening 56.

In operation, pile driving apparatus 20 functions as follows. Guide member 28 is inserted in a manner to be explained, into passage 62 of pile 22. After insertion of guide member 28, collar assembly 64 is clamped onto pile 22 in a location which provides a desired amount of upward movement of hammer 26 relative to pile 22. With guide member 28 engaged within passage 62 of pile 22, crane 10 is operated to raise hammer 26, such as to its position as shown in solid lines in FIG. 2. In this position, retainer chain 78 is taut and hammer 26 is spaced a predetermined distance above the upper end of pile 22. The crane operator then operates crane 10 to introduce slack into line 14 to allow hammer 26 to fall onto the upper end of pile 22, as shown in phantom in FIG. 2. A predetermined amount of energy is thus imparted to pile 22 with each drop of hammer 26, according to the weight of hammer 26 and the distance hammer 26 falls before engaging the upper end of pile 22. As noted, the amount of fall provided for hammer 26 is initially fixed by the length of retainer chain 78 and the position of collar assembly 64 on pile 22. After pile 22 is initially driven into the ground, collar assembly 64 and retainer chain 78 are removed. The operator then continues to operate crane 10 to raise and drop hammer 26 as described, maintaining guide member 28 within passage 62 of pile 22. Markings 29 are employed to provide the operator with an indication of the distance hammer 26 is raised, to ensure that the desired amount of energy is imparted to pile 22 for each drop of hammer 26.

Guide member 28 is dimensioned to provide a relatively close tolerance with the internal wall of pile 22 defining passage 64. Guide member 28 thus functions to guide upward movement of hammer 26 when hammer 26 is raised in response to lifting of line 14, and also to guide downward movement of hammer 26 when slack is introduced into line 14 to allow hammer 26 to fall. Collar assembly 64 and retainer chain 78 function to tether hammer 26 to pile 22 during initial driving of pile 22, to ensure that guide member 28 is not withdrawn from passage 62 of pile 22 during upward movement of hammer 26.

FIG. 5 illustrates an adaptation of the invention for use in connection with a large-diameter pile, such as shown at 80. Pile 80 defines an internal passage 82 having a diameter substantially larger than passage 62 of pile 22. In this instance, an auxiliary guide structure 84 is mounted to guide member 28.

As shown in FIGS. 5 and 6, auxiliary guide structure 84 includes series of radial plates 80 welded to guide member 28. Opposite pairs of plates 86 define a transverse dimension slightly less than the internal diameter of pile passage 82. Auxiliary guide structure 84 functions in the same manner as guide member 28, to guide upward and downward movement of hammer 26 within internal passage 82 of pile 80, in response to operation of crane 10 as outlined previously. When desired, auxiliary guide plates 86 can be removed from guide member 28 by cutting the welds by which plates 86 are mounted to guide member 28.

FIG. 7 shows an alternative arrangement for utilizing hammer 26 to drive an H-shaped or I-shaped pile 88. In this arrangement, a cylindrical pipe 90 is the underside of hammer 26 in place of guide member 28. Pipe 90 defines an internal passage adapted to receive pile 88, within the outer ends of the flanges of pile 88 in close tolerance to internal wall of pipe 90. Pile 88 again functions to guide upward and downward movement of hammer 26 by pipe 90 sliding over pile 90 during operation of crane 10.

FIG. 8 illustrates initial engagement of pile 22 with guide member 28. As shown, hammer 26 is lowered to the ground near pile 22 such that its longitudinal axis is horizontal, with guide member 28 extending substantially horizontally. A second line of crane 10, shown at 14, is engaged with pile 22, and line 14' is then raised to bring the open end of passage 62 of pile 22 into alignment with guide member 28. Pile 22 is then manually or otherwise pushed onto guide member 28 until the end of pile 22 engages the underside of hammer 26. Line 14' of crane 10 is then disengaged from pile 22, and line 14 is then lifted while the opposite end of pile 22 remains engaged with the ground, until pile 22 is positioned substantially vertically.

After pile 22 is fully engaged with guide member 28, collar assembly 64 is mounted to pile 22 in a position providing the desired amount of upward movement of hammer 26 when driving pile 22.

FIGS. 9 and 10 illustrate an adaptation of the invention for driving a battered pile 22. In this embodiment of the invention, a slide arrangement is mounted to hammer 26. The slide arrangement includes a pair of U-shaped brackets 92, 94 defining spaced legs which are bolted to plates 50, 52. Spacers, such as shown at 96, are located between the transverse portion of each U-shaped member 92 and bars, shown at 98. Bars 98 are spaced from the outer surface of the transverse portion of each U-shaped member 92, 94, with the space therebetween receiving the outer ends of one of the flanges of an H-shaped or I-shaped guide section, shown at 100. Section 100 is driven into the ground at an angle a, corresponding to the desired angle at which pile 22 is to be driven. After placement of section 100 as shown, hammer 26 is mounted to section 100 in a manner as shown in FIG. 10 by lowering hammer 26 relative to section 100 with the outer ends of the flange of section 100 being received between bars 98 and the transverse portion of U-shaped members 92, 94. Hammer 26 is then raised and lowered as described previously, in this instance providing non-vertical movement of hammer 26 to drive pile 22 at an angle.

Pile driving apparatus 20 is particularly well suited for driving a large number of relatively short piles. As can be appreciated, the task of disengaging apparatus 20 from one pile and re-engaging apparatus 20 with a subsequent pile is relatively easy and quick compared to prior art pile driving arrangements utilizing a lead assembly. Further, apparatus 20 substantially reduces the number of workers necessary to carry out a pile driving operation. Typically, only one worker on the ground is necessary, in addition to the crane operator, to rapidly and accurately drive piles. In addition, apparatus 20 can be employed in very tight spaces, such as between buildings or in locations where piles need to be driven close to an existing structure. Further still, pile driving apparatus 20 requires a much smaller capacity crane then is required to drive piles with a lead structure and powered hammer arrangement.

Various alternatives and embodiments are contemplated as being within the scope of the following claims particularly pointing out and distinctly claiming the subject matter regarded as the invention.

I claim:

1. A method of driving a pile, comprising the steps of:

providing a crane or the like having a line adapted for lifting and lowering in response to operation of the crane;

connecting a hammer to the line, the hammer including guide structure;

engaging the hammer guide structure with the pile; and driving the pile by raising the hammer and guide structure upwardly relative to the pile and dropping the hammer downwardly onto the pile, by operation of the crane, while maintaining the guide structure in engagement with the pile during both upward and downward movement of the hammer, whereby the pile functions to guide the hammer during upward and downward movement of the hammer, and wherein engagement of the hammer guide structure with the pile provides substantially the sole means for maintaining the position of the hammer relative to the pile during upward and downward movement of the hammer by operation of the crane.

2. The method of claim 1, wherein the hammer guide structure comprises a guide member engageable with the pile.

3. The method of claim 2, wherein the pile includes an axially extending passage, and wherein the step of engaging the hammer guide structure with the pile comprises moving the guide member into the axially extending passage of the pile, and wherein the step of maintaining the guide structure in engagement with the pile during upward and downward movement of the hammer comprises maintaining the guide member in engagement within the axially extending passage of the pile.

4. The method of claim 3, wherein the pile comprises a tubular member defining an enclosed passage, and wherein the guide member is provided with a cross section corresponding in shape to the enclosed passage of the pile.

5. The method of claim 4, wherein the guide member defines a transverse dimension less than that of the enclosed passage defined by the tubular pile, and further comprising the step of mounting auxiliary guide structure to the guide member for engagement within the enclosed passage.

6. The method of claim 3, wherein the step of maintaining the guide structure in engagement with the pile comprises interconnecting a flexible member between the hammer and the pile for preventing the hammer from being raised relative to the pile an amount sufficient to disengage the guide structure from the internal passage of the pile.

7. The method of claim 6, wherein the step of interconnecting a flexible member between the hammer and the pile comprises mounting a collar assembly to the pile, and interconnecting the flexible member between the hammer and the collar assembly.

8. The method of claim 1, further comprising the step of driving the pile at an angle by engaging the hammer with a beam engaged with the ground and disposed at an angle substantially corresponding to the angle at which the pile is to be driven, wherein the beam functions to guide the hammer for non-vertical up and down movement to drive the pile into the ground at an angle.

9. A method of driving a pile having an axially extending passage, comprising the steps of:

providng a crane or the laike having a line adapted for lifting and lowering in response to operation of the crane;

connecting a hammer to the lien, the hammer including guide structure in the form of a guide member extending from the hammer;

engaging the hammer guide structure with the pile by placing the hammer on a supporting surface such that the guide member extends laterally from the hammer, and moving the pile laterally toward the hammer such that the hammer guide member is engaged within the axially extending passage of the pile; and reciprocating the hammer in an up and down manner by operation of the crane while maintaining the guide structure in engagement . with the pile whereby the pile functions to guide the hammer during up and down movement of the hammer.

* * * * *